US008929559B2

(12) United States Patent
Splettstoeszer

(10) Patent No.: US 8,929,559 B2
(45) Date of Patent: Jan. 6, 2015

(54) METHOD AND APPARATUS FOR SELECTING RIGHT AND LEFT CIRCUIT CONFIGURATIONS OF HEARING ASSISTANCE DEVICES

(75) Inventor: Dale Splettstoeszer, Waconia, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 425 days.

(21) Appl. No.: 13/037,724

(22) Filed: Mar. 1, 2011

(65) Prior Publication Data

US 2012/0224704 A1 Sep. 6, 2012

(51) Int. Cl.
*H04R 25/00* (2006.01)

(52) U.S. Cl.
CPC ..... *H04R 25/552* (2013.01); *H04R 25/602* (2013.01); *Y10S 320/15* (2013.01)
USPC ..... 381/23.1; 381/312; 381/72; 320/165; 320/DIG. 15; 29/594

(58) Field of Classification Search
CPC ..... H04R 2460/03; H04R 2460/07; H04R 2460/11; H04R 2460/13; H04R 2460/15; H04R 2460/17; H04R 2440/05; H04R 2225/021; H04R 2225/023; H04R 2225/31; H04R 2225/33; H04R 2225/39; H04R 2225/53; H04R 2225/61; H04R 2225/81; H02J 2007/0098; H02J 2007/00; H02J 2001/006; H02J 7/0034; H02J 7/0036
USPC ..... 381/23.1, 312, 313, 314, 322, 323, 324, 381/327, 328, 329, 330, 331, 72; 320/165, 320/DIG. 15, DIG. 20, DIG. 26; 29/594, 29/609.1
See application file for complete search history.

(56) References Cited

U.S. PATENT DOCUMENTS

| | | | | |
|---|---|---|---|---|
| 5,734,976 | A * | 3/1998 | Bartschi et al. | 455/333 |
| 6,532,295 | B1 * | 3/2003 | Brimhall et al. | 381/328 |
| 6,546,110 | B1 * | 4/2003 | Vonlanthen | 381/330 |
| 2007/0258610 | A1 * | 11/2007 | Engbert et al. | 381/324 |
| 2009/0067653 | A1 * | 3/2009 | Meskens et al. | 381/315 |
| 2010/0088883 | A1 | 4/2010 | Kwon | |

FOREIGN PATENT DOCUMENTS

| | | | |
|---|---|---|---|
| EP | 2495999 | A2 | 9/2012 |
| WO | WO-2013123992 | A1 | 8/2013 |

OTHER PUBLICATIONS

"European Application Serial No. 12157478.4, Extended European Search Report mailed Jul. 23, 2013", 5 pgs.
"European Application Serial No. 12157478.4, Response filed Feb. 21, 2014 to Extended European Search Report mailed Jul. 23, 2013", 9 pgs.
"European Application Serial No. 12157478.4, Amendment filed Feb. 21, 2014", 9 pgs.

* cited by examiner

*Primary Examiner* — Leshui Zhang
(74) *Attorney, Agent, or Firm* — Schwegman Lundberg & Woessner, P.A.

(57) ABSTRACT

This disclosure relates to method and apparatus for selecting right and left configurations of hearing assistance device circuits, such as battery polarity. In various applications the present subject matter is applicable to a flexible circuit in hearing assistance devices, including but not limited to hearing aids. In one example, a printed circuit board is configured during manufacture to be used in either a left or a right hearing assistance device. The printed circuit board includes a solder selectable portion to provide for selection of left or right during assembly of the hearing assistance device, according to various embodiments.

20 Claims, 4 Drawing Sheets

METHOD AND APPARATUS FOR SELECTING RIGHT AND LEFT CIRCUIT CONFIGURATIONS OF HEARING ASSISTANCE DEVICES

TECHNICAL FIELD

This disclosure relates to hearing assistance devices and more particularly to selecting right and left circuit configurations of hearing assistance devices.

BACKGROUND

Hearing assistance devices are used to improve hearing for wearers. Such devices include, but are not limited to, hearing aids. Patients often have a need for hearing aids for both left and right ears. Many modern hearing aids require opposite battery polarity between the hearing aid for the right ear and the hearing aid for the left ear. Thus, circuits for the right hearing aid have a different manufacturing design than circuits for the left hearing aid.

What is needed in the art is a system for elegantly and rapidly selecting right and left configurations of hearing assistance devices. In various applications, the configuration selection may allow for selectable battery polarity in a hearing assistance device circuit. The system should be available for use with various hearing assistance devices, such as hearing aids.

SUMMARY

This document provides methods and apparatus for selecting right and left configurations of hearing assistance device circuits. For example, such configurations may allow for selectable battery polarity for a printed circuit board in hearing assistance devices, including but not limited to hearing aids. According to an embodiment, a hearing assistance device includes a printed circuit board configured during manufacture to be used in either a left or a right configuration of a hearing assistance device. The printed circuit board includes a solder selectable portion to provide for selection of left or right configuration during assembly of the hearing assistance device, according to various embodiments.

Another aspect of the present subject matter includes a printed circuit board configured for use in either a left or a right hearing assistance device. The printed circuit board includes a solder selectable portion configured to provide for selection of left or right configuration of the hearing assistance device, according to an embodiment. The solder selectable portion includes a first portion adapted to be soldered to select a left hearing assistance device configuration and a second portion adapted to be soldered to select a right hearing assistance device configuration, in various embodiments.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

Figure 1:
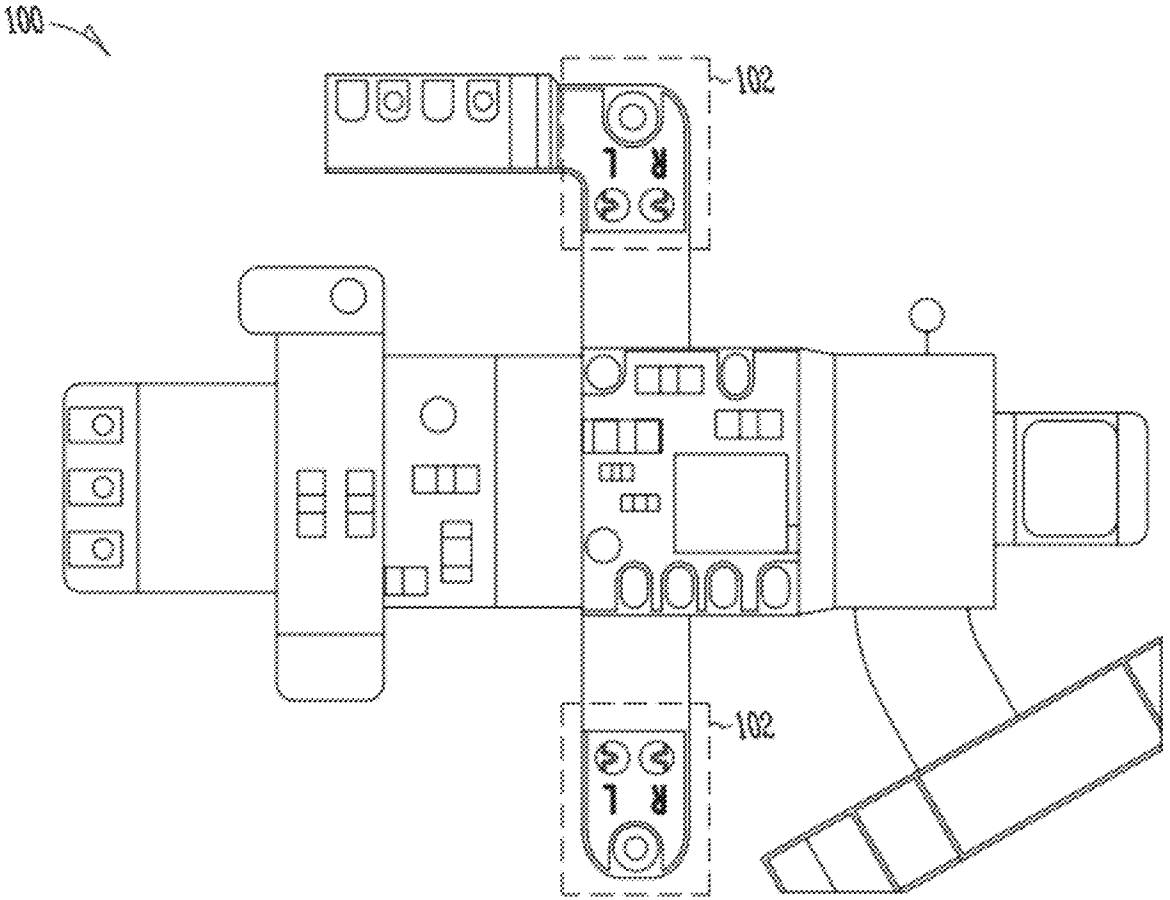
FIG. 1 illustrates a flat flexible circuit with selectable right and left circuit configurations, for example battery polarity, for a hearing assistance device, according to various embodiments of the present subject matter.

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

This present subject matter provides for selecting a right or left configuration of a hearing assistance device, such as a hearing aid. In various embodiments, the polarity of a battery in the hearing assistance device can be adjusted for either a right hand use or a left hand use. In various embodiments, solder selectable jumper fingers are used on a flexible circuit to allow selection between a positive or negative battery connection. In one embodiment, the flexible circuit includes four solder selectable jumper fingers. Other shapes of solderable connections may be used without departing from the scope of the present subject matter.

Prior custom hearing aids contain a ceramic hybrid circuit which is hand wired to additional components of the hearing aid. Modern custom hearing aids move away from the ceramic hybrid circuit and toward a flexible circuit. A challenge faced with the use of flexible circuits is the difference in battery polarity between the hearing aid for the right ear and the hearing aid for the left ear. Currently, the batteries are inserted in opposite directions for the left and right hearing aids. The present subject matter provides a single flexible circuit which can be used in either a right or left hearing aid, and still have the polarity of the battery connected properly.

Typically, a set (left and right) of custom hearing aids would require two circuits, one designed for the right ear and one designed for the left ear. This present subject matter eliminates one of those circuits and will allow the same flexible circuit to be used in both hearing aids. By solder bridging a small jumper, or gap in the wiring, the circuit will be configured for either a right or a left hearing aid. This solder bridging can be accomplished in a number of ways without introducing any new materials or processes. At the time of assembly to the faceplate, the assembler can use a soldering iron to bridge the desired jumpers, in one embodiment. In another embodiment, at the time of flexible circuit population solder could be screen printed onto the desired set of jumpers and then reflowed with the rest of the components. This can be done using one screen for the right hearing aids and one screen for the left hearing aids. This can also be done screening all four jumper positions with one screen and having the assembler remove the solder from the undesired jumpers at time of assembly to the faceplate. The present subject matter provides a benefit for material management only having to purchase and track one flexible circuit instead of two, thereby doubling the number of the one circuit needed to purchase, and furthermore reducing the cost per circuit.

The present subject matter provides methods and apparatus for selecting battery polarity for a printed circuit board in hearing assistance devices, including but not limited to hearing aids. According to an embodiment, a hearing assistance device includes a printed circuit board configured during manufacture to be used in either a left or a right hearing assistance device. The printed circuit board includes a solder selectable portion to provide for selection of left or right during assembly of the hearing assistance device, according to various embodiments.

According to various embodiments, the printed circuit board includes a flexible circuit. The solder selectable portion includes a jumper finger, in an embodiment. According to various embodiments, the solder selectable portion includes a first portion adapted to be soldered to select a left hearing assistance device and a second portion adapted to be soldered to select a right hearing assistance device. A first and second contact are separated by a gap. The first and second contact can be connected with a solder bridge, jumper, a switch, a gate, or other conductive device. The contacts of the first portion and the second portion can have a variety of shapes. In various embodiments, the contacts can have a circular shape, a crescent shape, a square shape, or an irregular shape. Other shapes can be used without departing from the scope of the present subject matter.

Another aspect of the present subject matter includes a printed circuit board that can be programmably configured for use in either a left or a right hearing assistance device. The printed circuit board includes a solder selectable portion configured to provide for selection of left or right during assembly of the hearing assistance device, according to an embodiment. The solder selectable portion includes a first portion adapted to be soldered to select a left hearing assistance device and a second portion adapted to be soldered to select a right hearing assistance device, in various embodiments.

According to various embodiments, the printed circuit board includes a flexible circuit. The solder selectable portion includes a jumper finger, in an embodiment. According to various embodiments, the solder selectable portion includes a first portion adapted to be soldered to select a left hearing assistance device and a second portion adapted to be soldered to select a right hearing assistance device. The first portion and the second portion can have a circular shape, a crescent shape or a square shape, in various embodiments. Other shapes can be used without departing from the scope of the disclosure. According to various embodiments, the solder selectable portion is adapted to be screen printed for selection of left or right hearing assistance device.

FIG. 1 illustrates a flat flexible circuit with selectable right and left configurations, for example battery polarity, for a hearing assistance device, according to various embodiments of the present subject matter. The flexible circuit 100 includes a solder selectable portion 102 configured to accommodate a selection of a right or left configuration, such as a positive battery connection or a negative battery connection. A battery is connected between the terminals in a single orientation, according to various embodiments. The flexible circuit 100 is configured for use in a right ear hearing assistance device or a left ear hearing assistance device based on the selection. The selection is made by applying an amount of solder to the 2 circles above the R's for a right device or the 2 circles above the L's for a left device. Different shapes can be used without departing from the scope of the disclosure. The solder, or other conductive material, connects metallic traces on the circuit board to complete an electrical circuit. In various embodiments, the wires are connected to complete the electrical circuit. By applying the conductive material to the R portions, the battery polarity is provided for a right hearing device. By applying the conductive material to the L portions, the battery polarity is provided for a left hearing device. The flexible circuit of FIG. 1 includes a portion for hearing aid electronics, including a processor and control circuitry, in various embodiments. The circuit is flexible, and can be folded at the dashed lines to receive the battery (not shown).

It is understood that the predetermined, selectable, and programmable aspect of the present subject matter can be used for other uses besides battery polarity. For example, such an approach can be used to select a set of contacts for a receiver or microphone. Other applications are possible without departing from the scope of the present subject matter.

Figure 2:
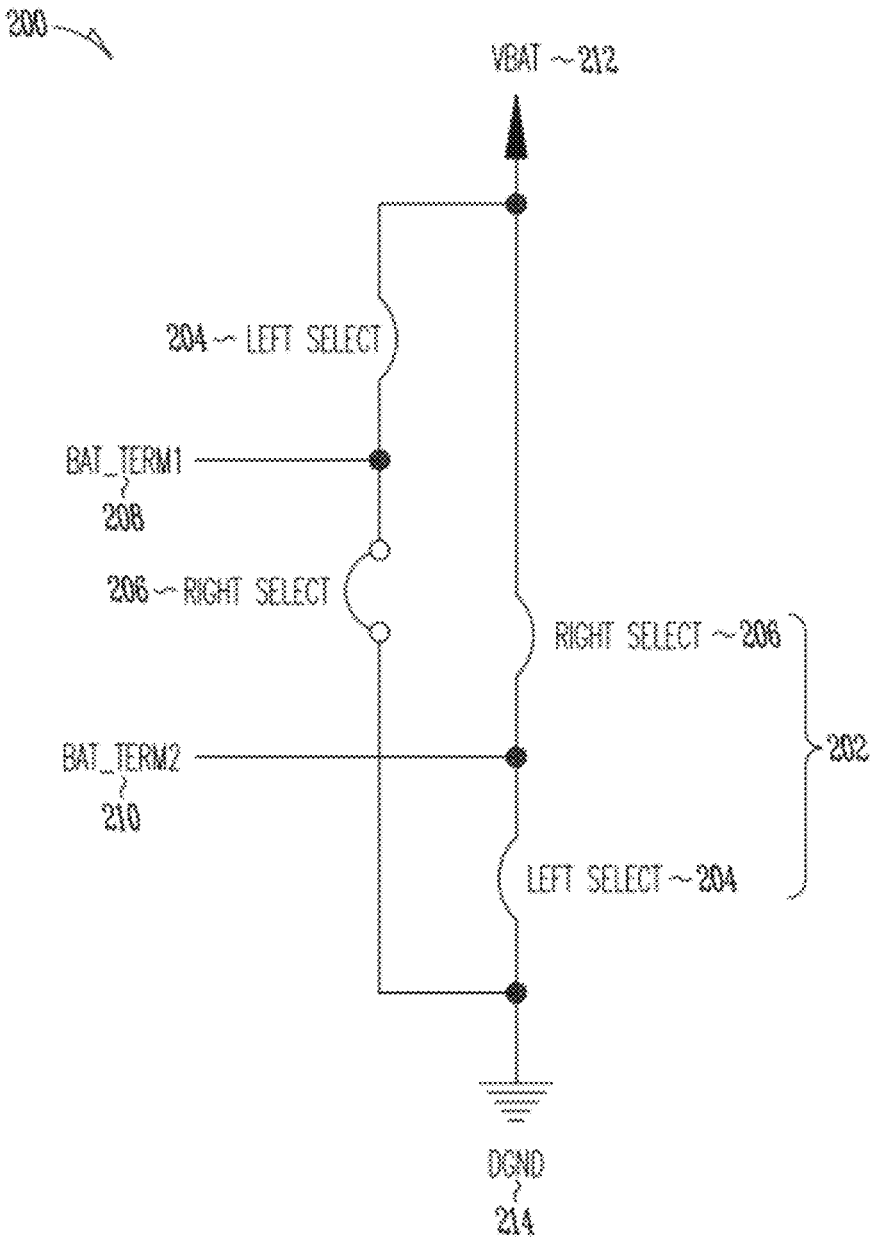
FIG. 2 illustrates a schematic diagram of a printed circuit board with selectable right and left circuit configurations, for example battery polarity, for a hearing assistance device, according to various embodiments of the present subject matter.

FIG. 2 illustrates a schematic diagram of a printed circuit board with selectable configurations, such as battery polarity, for a hearing assistance device, according to various embodiments of the present subject matter. The printed circuit board is configured for use in either a left or a right hearing assistance device. In various embodiments, the printed circuit board includes a flexible circuit (or flex circuit). The printed circuit board 200 includes a solder selectable portion 202 configured to provide for selection of left or right during assembly of the hearing assistance device, according to an embodiment. The solder selectable portion includes a first portion 204 adapted to be soldered to select a left hearing assistance device and a second portion 206 adapted to be soldered to select a right hearing assistance device, in various embodiments. In FIG. 2, the first portion 204 has been soldered to select a left hearing assistance device. The soldered portion 204 connects the battery terminals 208, 210 to provide a positive voltage 212 with respect to a grounded connection 214.

In one embodiment, a conductive material, such as solder or a screen print, is applied to portions 204. In this embodiment, the first battery terminal 208 is connected to voltage supply 212 and the second battery terminal 210 is connected to device ground 214, such that the device is a left hearing device. In another embodiment, the conductive material is applied to portions 206. In this embodiment, the second battery terminal 210 is connected to voltage supply 212 and the first battery terminal 208 is connected to device ground 214, such that the device is a right hearing device. Thus, the present subject matter provides for the use of a single circuit board 200 with a single battery orientation for use in either a left or right device.

Figure 3:
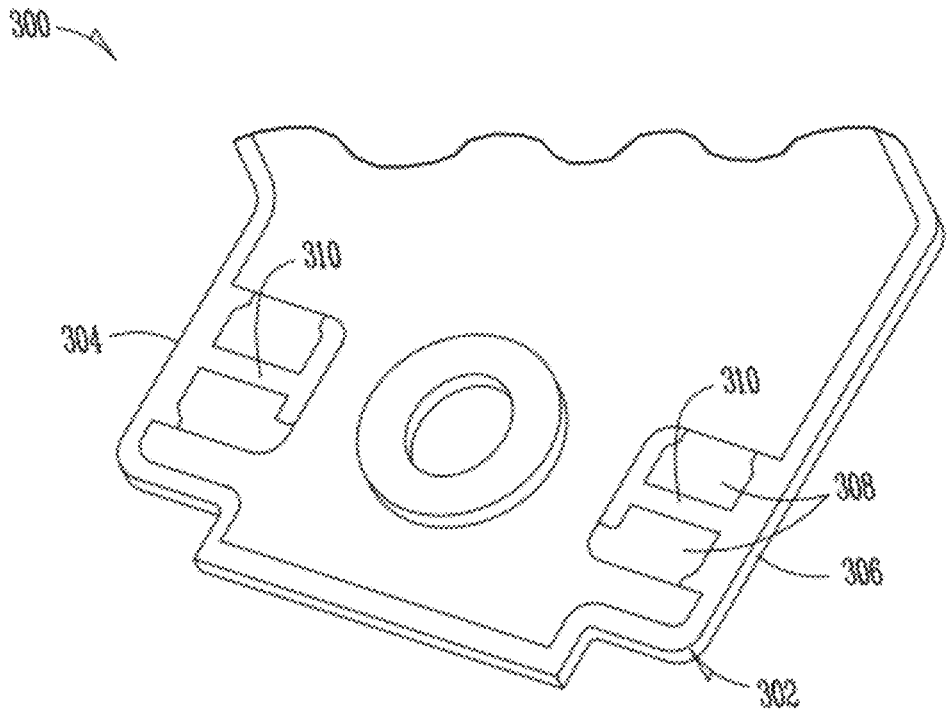
FIG. 3 illustrates a portion of a printed circuit board with selectable right and left circuit configurations, for example battery polarity, for a hearing assistance device, according to various embodiments of the present subject matter.

FIG. 3 illustrates a portion of a printed circuit board with selectable configuration aspect, such as battery polarity, for a hearing assistance device, according to various embodiments of the present subject matter. The printed circuit board is configured for use in either a left or a right hearing assistance device. The printed circuit board 300 includes a solder selectable portion 302 configured to provide for selection of left or right during assembly of the hearing assistance device, according to an embodiment. The solder selectable portion includes a first portion 304 adapted to be soldered to select a left hearing assistance device and a second portion 306 adapted to be soldered to select a right hearing assistance device, in various embodiments. The first and second portions (304, 306) include metal traces 308 separated by a gap 310. A solder is used to select left or right by connecting or bridging the metal traces 308 on either the first portion or the second portion, according to various embodiments. FIG. 3 illustrates square metallic traces 308, but other shapes, for example circular or crescent shapes as shown in FIGS. 1 and 4, can be used without departing from the scope of the disclosure.

Figure 4:
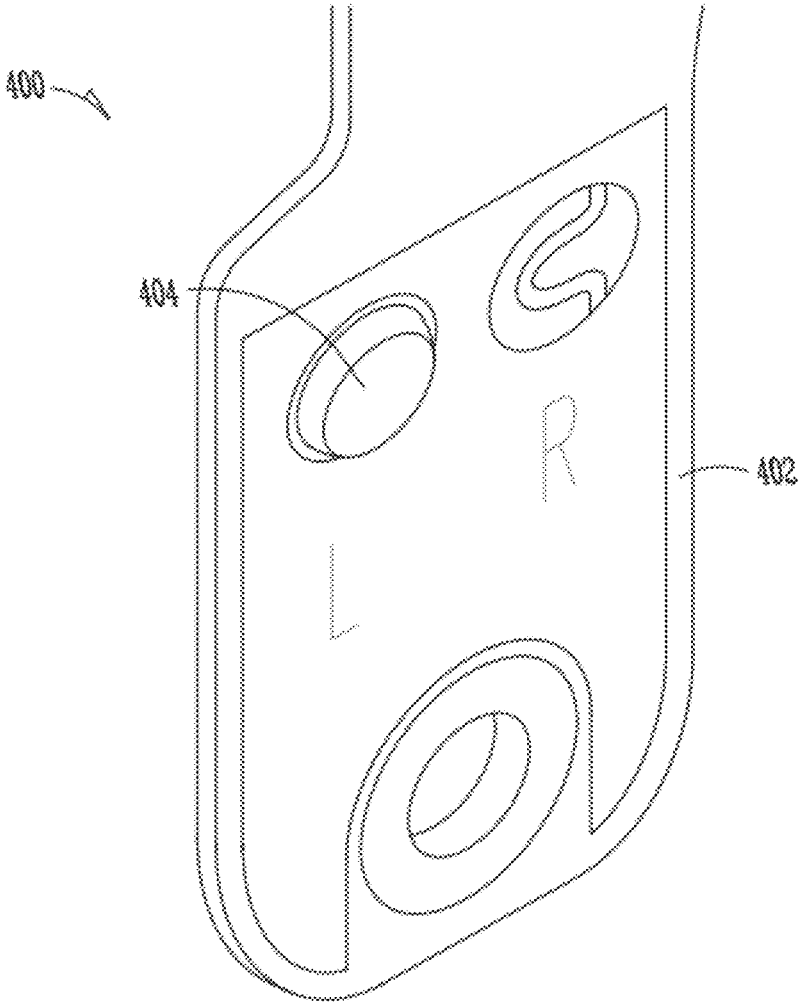
FIG. 4 illustrates a portion of a folded flexible circuit with selectable right and left configurations, such as battery polarity, that is selected for a left hearing assistance device, according to one embodiment of the present subject matter.

FIG. 4 illustrates a folded flexible circuit with a selectable configuration aspect, such as battery polarity, selected for a left hearing assistance device, according to one embodiment of the present subject matter. The flexible circuit 400 includes a solder selectable portion 402 configured to accommodate a selection of a positive battery connection or a negative battery connection. The flexible circuit 400 is configured for use in a left ear hearing assistance device, as the solder bridge 404 for the left device has been selected. This solder bridging can be accomplished in a number of ways without introducing any new materials or processes. At the time of assembly to the faceplate, the assembler can use a soldering iron to bridge the desired portions, in one embodiment. In another embodiment, at the time of flexible circuit population solder could be screen printed onto a desired set of jumpers and then reflowed with the rest of the components. This can be done using one screen for the right hearing aids and one screen for the left hearing aids. This can also be done screening all four jumper positions with one screen and having the assembler remove the solder from the undesired jumpers at time of assembly to the faceplate.

The present subject matter includes hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. It is understood that other hearing assistance devices not expressly stated herein may fall within the scope of the present subject matter. While the present disclosure refers to hearing aids, it is understood that any of the above-mentioned hearing assistance devices can be used without departing from the scope of the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A custom hearing aid device, comprising:

a printed circuit board manufactured to be configured for the hearing aid device in either a left ear or a right ear of a wearer of the hearing aid device, the printed circuit board including a solder selectable portion to provide for battery polarity selection for the printed circuit board during assembly for left or right configuration of the hearing aid device, wherein the left configuration is selected via said solder selectable portion to yield an opposite battery polarity from the right configuration.

2. The hearing aid device of claim 1, wherein the printed circuit board includes a flexible circuit.

3. The hearing aid device of claim 1, wherein the solder selectable portion includes a jumper finger.

4. The hearing aid device of claim 1, wherein the solder selectable portion includes a first portion that can be soldered to select a first polarity configuration of a battery of the hearing aid device and a second portion that can be soldered to select a second polarity configuration of the battery of the hearing aid device.

5. The hearing aid device of claim 4, wherein the first portion and the second portion have contacts of a circular shape.

6. The hearing aid device of claim 4, wherein the first portion and the second portion have contacts of a crescent shape.

7. The hearing aid device of claim 4, wherein the first portion and the second portion have contacts of a square shape.

8. The hearing aid device of claim 1, wherein the hearing aid device includes a cochlear implant.

9. The hearing aid device of claim 1, wherein the hearing aid device is a hearing aid.

10. The hearing aid device of claim 9, wherein the hearing aid is a behind-the-ear (BTE) hearing aid.

11. The hearing aid device of claim 9, wherein the hearing aid is an in-the-ear (ITE) hearing aid.

12. The hearing aid device of claim 9, wherein the hearing aid is an in-the-canal (ITC) hearing aid.

13. The hearing aid device of claim 9, wherein the hearing aid is a completely-in-the-canal (CIC) hearing aid.

14. A printed circuit board manufactured to be configured for either a left custom hearing aid device or a right custom hearing aid device, the printed circuit board comprising:

a solder selectable portion configured to provide for battery polarity selection for left or right configuration for the printed circuit board during assembly of the hearing aid device, the solder selectable portion including:

a first portion adapted to be soldered to select a left hearing aid device; and a second portion adapted to be soldered to select a right hearing aid device, wherein the left configuration is selected via said solder selectable portion to yield an opposite battery polarity from the right configuration.

15. The printed circuit board of claim 14, wherein the printed circuit board includes a flexible circuit.

16. The printed circuit board of claim 14, wherein the solder selectable portion includes a jumper finger.

17. The printed circuit board of claim 14, wherein the first portion and the second portion have circular shaped contacts.

18. The printed circuit board of claim 14, wherein the first portion and the second portion have crescent shaped contacts.

19. The printed circuit board of claim 14, wherein the first portion and the second portion have square shaped contacts.

20. The printed circuit board of claim 14, wherein the solder selectable portion is adapted to be screen printed for selection of left or right hearing aid device.

* * * * *

UNITED STATES PATENT AND TRADEMARK OFFICE

CERTIFICATE OF CORRECTION

PATENT NO. : 8,929,559 B2
APPLICATION NO. : 13/037724
DATED : January 6, 2015
INVENTOR(S) : Dale Splettstoeszer It is certified that error appears in the above-identified patent and that said Letters Patent is hereby corrected as shown below:

In the Claims

In column 6, line 40, in Claim 14, after "and", insert --¶--, therefor

Signed and Sealed this
Fourth Day of August, 2015

Michelle K. Lee

Michelle K. Lee
*Director of the United States Patent and Trademark Office*